US005383721A

United States Patent [19]

Thomas

[11] Patent Number: 5,383,721

[45] Date of Patent: Jan. 24, 1995

[54] STAND FOR LARGE SCREEN TELEVISION SETS

[76] Inventor: Nathaniel Thomas, 10937 S. Emerald Ave., Chicago, Ill. 60628

[21] Appl. No.: 980,758

[22] Filed: Nov. 24, 1992

[51] Int. Cl.[6] ..... A47B 81/06

[52] U.S. Cl. ..... 312/7.2; 312/249.11; 292/137

[58] Field of Search ..... 312/7.2, 10.1, 222, 312/249.8, 249.11, 290, 287, 328; 108/27, 54.1, 55.1; 292/32, 42, 137

[56] References Cited

U.S. PATENT DOCUMENTS

| | | | |
|---|---|---|---|
| 1,244,647 | 10/1917 | Shaw | 312/287 X |
| 1,780,353 | 11/1930 | Jones | 312/287 X |
| 2,023,356 | 12/1935 | Fain | 312/138.1 X |
| 2,306,209 | 12/1942 | Elofson et al. | 312/223.3 |
| 2,313,180 | 3/1943 | Tathwell | 312/282 |
| 2,344,800 | 3/1944 | Butcher | 312/287 X |
| 2,543,136 | 2/1951 | Sweeney . | |
| 2,564,940 | 8/1951 | Weber | 312/328 X |
| 2,669,373 | 2/1954 | Coit, Jr. | 108/55.1 X |
| 2,738,940 | 3/1956 | Coit, Jr. | 108/55.1 X |
| 3,087,767 | 4/1963 | Schell | 312/290 X |
| 3,727,000 | 4/1973 | Lollos . | |
| 4,002,831 | 1/1977 | Aeschliman . | |
| 4,021,105 | 5/1977 | Schubach . | |
| 5,125,725 | 6/1992 | Blunt | 312/7.2 |

*Primary Examiner*—Brian K. Green
*Attorney, Agent, or Firm*—Olson & Hierl, Ltd.

[57] ABSTRACT

A television (TV) stand which facilitates the support, placement and removal of a TV, particularly a large screen TV, includes a horizontal panel support and opposed pairs of upstanding sidewalls that are attached to and extend upwardly beyond the panel. One pair of these sidewalls has members fixed in an upright configuration while the other pair has members which are pivotal. The pivotal wall members are each engagable with the fixed wall members by latches.

2 Claims, 1 Drawing Sheet

STAND FOR LARGE SCREEN TELEVISION SETS

FIELD OF THE INVENTION

The present invention relates to television ("TV") stands and in particular to a TV stand that is particularly well adapted for positioning and supporting large screen TVs.

BACKGROUND OF THE INVENTION

In recent years, sales of large screen TVs have substantially increased. As used herein, the term "large screen TV" refers to a television receiver having a viewing screen with a diagonal width of at least about 35 inches and an area of at least about 500 square inches. The viewing screen of a large screen TV can be constituted by either the viewing screen surface of a conventional cathode ray tube or by the screen surface of a conventional TV projection system.

A common accessory that is purchased with a small-to-medium size TV is a stand upon which to rest the TV. However, because of the excellent brightness and clarity of images produced with small-to-medium size TVs, it is relatively unimportant for purposes of viewability whether or not such a TV is elevated.

However, at present, in the case of large screen TVs, technology has not produced, and consumers are not provided with, large screen TV that offer brightness and clarity comparable to the small-to-medium TVs. Thus, elevation of large screen TVs is necessary for purposes of improving viewability.

In general, elevating a TV of any size results in better viewing by achieving a less-obstructed, line-of-sight screen viewing capability. Also, elevating a TV repositions its control panel to a more comfortable and reachable position which eliminates unnecessary bending or movement by the user in order to manually operate, control and select switches associated with a TV and its operations. For example, the cable-to-TV switch is manually actuated which cannot be achieved via remote control.

Prior art TV stands are presently constructed to support and elevate only small-to-medium size TVs. Small-to-medium size TVs for present purposes are considered characteristically to have viewing screen areas that are typically less than about 500 square inches. The requirements and characteristics needed for a stand for a large screen TV are generally different from those needed for small-and-medium size TVs. In general, a stand for a small-to-medium size TV is not suitable for use with a large screen TV, although small-to-medium size TVs could be placed upon a large screen TV stand if such stand were available and also were adapted for such usage.

One problem is that a TV stand for small-to-medium size TVs typically does not have a structure or structural configuration that is strong enough and stable enough to support the weight of a large screen TV. Another problem is that a large screen TV does not fit well on a stand for a small-to-medium size TV and usually is not safely restrained when resting thereon against lateral sliding movements. Such a TV stand restraining capacity may not be needed with small and medium sized TVs. Another problem is that a large screen TV cannot be placed upon, and removed from, a support stand for a small-to-medium size TV in a manner that is safe, effective and simple.

Indeed, for use in supporting large screen TVs, all known prior art TV stands are cumbersome, difficult to use, and dangerous to installing personnel and users generally. For example, conventional TV stands of the types adapted for supporting small-to-medium TVs either have a flat, unenclosed surface from which a large screen TV that rests thereon can slide off, or have upstanding, fixed position side and end walls about the top surface perimeter defining an enclosed top area within which a TV rests and is restrained against lateral sliding movements. Normally, this enclosed surface area is not sized properly to receive and support the base of a large screen TV.

Also, even if a large screen TV has a base which fits into such an enclosed surface area that is designed for a small-to-medium size TV, a large screen TV requires at least two installers. Typically, the installers support the TV on its opposite ends. They grip the TV along its bottom perimeter, and lift the TV up until its bottom surface is raised to a level that is above the upstanding sidewalls. Then, they swing the TV over the supporting surface and lower the TV into place within the enclosed surface area of the TV stand.

While this positioning method is somewhat successful in securing a small-to-medium relatively lightweight TV within an enclosed top area of a stand, it proves to be inadequate, unsafe and potentially harmful to the hands of those lifting and depositing a heavy, large screen TV within such an enclosed top surface area. Usually, the lateral clearance (i.e., space) between the fixed walls of such a TV stand and the base of a large screen TV is minimal and very limited at best so that the installers are not afforded enough room to manipulate their hands and to safely remove their fingers during the depositing. As a result, fingers can be easily injured.

In addition, prior art TV stands are not adjustable so as to safely accommodate TVs of various sizes. For example, a TV stand of the type having upstanding vertical fixed sidewalls is normally constructed to contain the base of a 13", 19" or 25" diagonal screen TV which is in the small-to-medium size TV range. Large screen TVs are not adapted for use or positioning on such prior art TV stands especially because of their larger weight and size. Also, if a user were to set a small or medium size TV on a large screen TV stand (with fixed upstanding sidewalls, assuming such a stand were to be available), then that small-to-medium size TV would be slidably too mobile within the enclosed area, thereby making that TV not only unsafe, but also more susceptible to injury caused by scratches, bumps, dents and the like which cause external or internal component damage.

So far as now known, there is not available a TV stand structure that is suitable for safely positioning and supporting a large screen TV, that overcomes the foregoing problems, and that is also suitable, if desired, for use with small-to-medium size TVs.

Since TV stands that are suitable for use with large screen TVs are not available, users of large screen TVs simply either set their large screen TV directly on the floor, or set their costly large screen TV upon a crate, box or other improvised supporting apparatus which can be unstable and/or unsafe. The art needs a new and safe TV stand that is particularly well-adapted for supporting large screen TVs.

SUMMARY OF THE INVENTION

The present invention provides a new and very useful TV stand that is adapted for supporting large screen TVs, that overcomes the foregoing problems and disadvantages, and that is safe for installers and users.

The inventive TV stand incorporates a rectangular, horizontally extending, flattened, load-bearing platform panel means that is held in spaced relationship to an underlying floor by support means. The panel means is provided with opposing pairs of upstanding end and side walls that are located about the panel perimeter and that extend upwards relative to the panel. The opposed end walls are preferably rigidly mounted, and the opposed side walls are preferably pivotally mounted so as to be movable between upright and downturned positions. Latch means are provided for retaining the side walls in a locked, upright configuration relative to the end walls.

Optionally, but preferably, the inventive TV stand is also provided with chock brackets on the panel for retaining a TV in a particular location on the panel. Preferably, the chock brackets are themselves positionable at various locations on the panel for use with TVs of varying base configurations.

A feature of the inventive TV stand is that a TV, particularly a large screen TV, can be placed on, or removed from, the panel surface without significant danger to hands and fingers since opposing side walls are each pivotable to out-of-the-way positions during TV positioning on the panel surface.

An object of this invention is to provide a TV stand which is adapted for safe positioning and use with both small-to-medium size TVs and also with large screen TVs.

Another feature is that a TV, particularly a large screen TV, is retained on the panel surface by the upright side and end walls so that it is not slidably displacable from the panel surface during use even when the TV stand is mounted on casters or the like.

Another advantage of the present invention is that the TV stand can be provided on its top surface with adjustable chock bracket means so that the TV stand is adaptable for use with TVs of widely ranging screen sizes and base sizes including large screen TVs.

Another aim of the present invention is to provide a TV stand that can, in effect, assist installers in placing a TV on, or in removing a TV from, the TV stand.

Another benefit of the present invention is the provision of a TV stand that optionally contains a storage region, especially compartments, which are below the platform panel which can be used for containing accessories, videotapes and the like.

These and other objects, aims, benefits, features aspects, embodiments, advantages and the like of the present invention will be apparent to those skilled in the art from the following description taken with the accompanying drawings and the appended claims.

DETAILED DESCRIPTION

Figure 1:
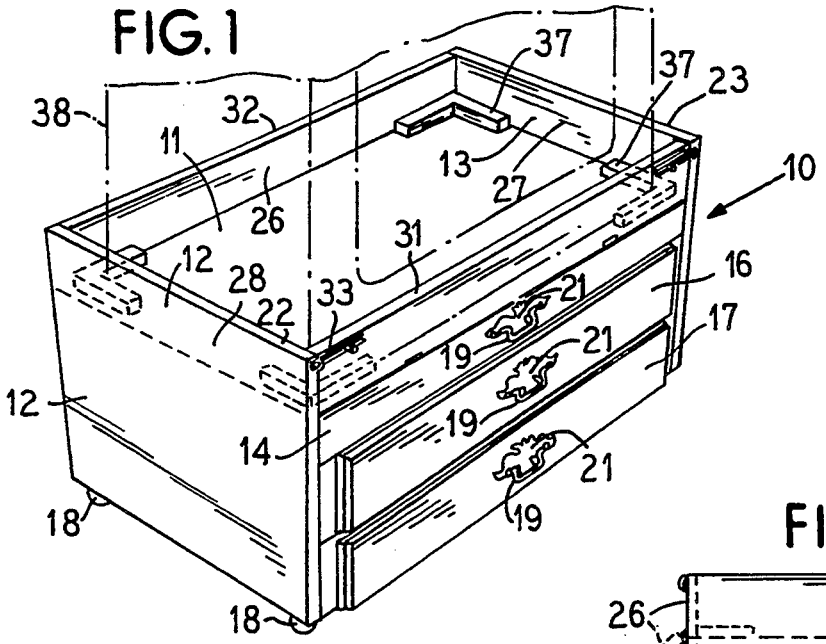
FIGURE 1 is a perspective view of one embodiment of my TV stand showing fragmentarily in phantom a large screen TV supported on the stand.

Referring to FIGS. 1–4, there is seen one embodiment 10 of a television (TV) stand of this invention. TV stand 10 incorporates a rectangular, horizontally oriented, flattened, load-bearing platform panel 11 which forms the top support surface of stand 10. Panel 11 is supported in vertically spaced relationship to the floor by means of a pair of opposed (square or rectangular) end panels 12 and 13 which are themselves transversely supported and braced by front side brace 14 and a rear wall 51. Also, stand 10 includes a horizontal bottom panel 52 and preferably internal cabinetry (not detailed) for operably supporting horizontally and transversely slidable conventional drawers 16 and 17.

The construction and materials of construction are conventional. A present preference is to employ wood, plywood, laminate or vineer composition board, and/or the like in fabricating stand 10. A caster 18 is mounted beneath each of the lower corners of the stand 10. Preferably, the location of each caster 18 is such that its profile remains within a downward projection of adjacent end and side wall portions of stand 10.

The front panel of each drawer is equipped with a handle 19 backed by a decorative escutcheon plate 21. For convenience purposes of moving (rolling) the stand 10, the brace 14 is optionally equipped with a handle 19 and an escutcheon plate 21.

The upper portion of each end panel 12 and 13 extends upwardly above the surface of panel 11 to define end walls 27 and 28, and top edges 22 and 23, respectively, at each opposed end of panel 11. A side wall 24 and 26 is provided for the front and the back opposed side of panel 11. Each side wall 24 and 26 is hinged relative to its associated side edge of panel 11 so as to be pivotable between an upright position such as shown in FIG. 1 where opposite end edges of each wall 24 and 26 are each in adjacent relationship to portions of the inside face of each end wall 27 and 28 at their respective opposite ends. The hinge means employed in stand 10 for each side wall 24 and 26 comprises a pair of spaced hinges 29; however, any convenient hinge means can be employed.

Figure 2:
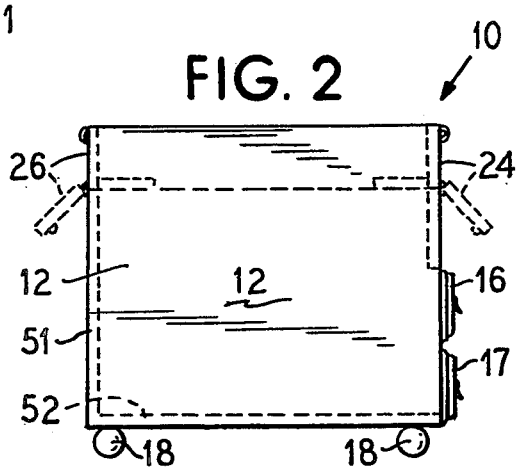
FIG. 2 is an end view of FIG. 1.

The position of each side wall 24 and 26 when in an upturned vertical or upright configuration and in a downturned configuration is preferably as shown by the dotted lines in FIG. 2. The downturned configuration is preferably at least 90° (or horizontal) relative to the upturned position. In one preferred arrangement (not shown) each side wall 24 and 26 is rotated through about 180° from its closed upright position so as to hang downwardly and vertically adjacent to portions of stand 10 (not shown). The top edge 31 and 32 of each side wall 24 and 26 is preferably and as shown equal in height to the top edge 22 and 23 of end walls 27 and 28.

When the side walls 24 and 26 are pivoted downwards, a passageway is effectively formed between the end walls 27 and 28 which facilitates the placement upon, and the removal of, a TV from the surface of panel 11. During such placement or removal, the region or fixed end walls 27 and 28 function as an aid in preventing undesired lengthwise movement of the TV.

Figure 4:
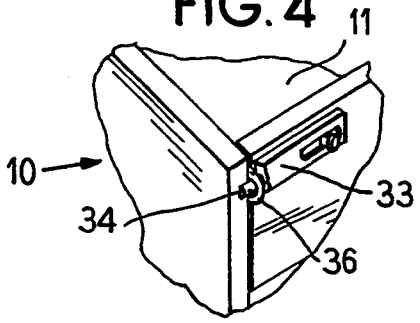
FIG. 4 is an enlarged, fragmentary view of the forward upper corner region of FIG. 1 showing details of the side wall latch arrangement.

To engage and latch each side wall 24 and 26 to each end wall 27 and 28, the upper outside face of each side wall 24 and 26 adjacent its respective top edge 31 and 32 is associated with a conventional sliding bolt assembly 33 (see FIG. 4). The bolt 34 of each assembly 33 is adapted for extension over an adjacent portion of the end edge of the adjacent end wall 27 or 28, as the case may be, such as shown, for example, in FIG. 4.

In embodiment 10, the upper inside face of each end wall 27 and 28 adjacent its respective top edge 31 and 32 is associated with a flattened eyelet 36. Each eyelet 36 projects laterally outwardly beyond each opposed end edge of each end wall 27 and 28. Each eyelet 36 is positioned so that the adjacent bolt 43 when extended passes through the eyelet 36, thereby latching the side walls 24 and 26 when in their respective upright position to the end walls 27 and 28. In place of an eyelet 36, various other bolt receivers can be employed as is known in the art.

Various latching means other than bolt means can be employed in stand 10, as those skilled in the art will also readily appreciate. However, a sliding bolt assembly 33 such as shown and described for embodiment 10 is now preferred because of its ability to achieve in a simple and effective manner a positive interlocking type of engagement between end edge portions of the side walls 24 and 26 and the end walls 27 and 28. In the bolt 34 extended position, the bolt 34 preferably is either somewhat frictionally engaged with its adjacent assembly or the bolt 34 is itself pivoted into a locked position. Such a positive engagement between the wall ends is not disrupted by either internal or external forces applied to either side walls 24 and 26 or end walls 27 and 28.

For example, if spring-biased connectors were utilized alternatively at the adjoining edge portions of the side walls 24 and 26 and the end walls 27 and 28 for wall latching purposes, then there is a danger that laterally exerted pressure, such as from sliding movement of a TV located inside these walls upon the surface of panel 11, could disengage the latching which would produce a dangerous and undesired result.

Preferably, the latch means for the walls is located outside surface portions of the walls, but interior mounting and locating of the latch means can be used if desired.

In use, the bolt assemblers 33 are unlatched, side walls 24 and 26 are unlatched and pivoted downwards from the end walls 27 and 28, and a TV is then lifted and deposited upon the surface of panel 11. Since the sides are open, no hand or finger interference during the positioning is involved because an installer's hands and wrists can be located upon opposite bottom sides of the TV adjacent the end bottom of the TV. Thereafter, the side walls 24 and 26 can be pivoted upwards and latched to the end walls 27 and 28.

Optionally, but preferably, a stand is also provided with chock bracket means. In stand 10, at least two and preferably four substantially L-shaped chock brackets 37 are provided. Four chock brackets 37 are shown in stand 10. Each chock bracket 37 is located flat against the surface of panel 11 and is illustratively positioned at a different panel 11 corner adjacent to where the end walls and side walls converge when the side walls are in their upper (upright) respective positions. Preferably, and as shown, the resulting configuration of the chock brackets 37 is such that the inside edges of each chock bracket 37 are in contacting engagement with adjacent outside edge portions of the base of a TV, such as a large screen TV 38 which is partially shown in phantom in FIG. 1.

In stand 10, the chock brackets 37 can be, if desired, mounted to the underlying stand portions by screws, adhesive, or the like. In one presently preferred embodiment, the under surface of each chock bracket 37 is provided with a self-sticking layer (not shown but of a known type) of an adhesive which securely but releasably bonds the under surface to the upper surface of the panel 11. Initially, this layer is covered by a peelable release sheet (not shown). Thus, once a TV is positioned on the surface of panel 11, as above described, the release sheet associated with each chock bracket 37 is peeled away and each chock bracket 37 is positioned adjacent a different corner of the base of the TV, such as TV 38 or the like, thereby restraining movement of the TV.

Instead of using four chock brackets 37, only two can be used if desired. Thus, for example, a TV can be positioned on stand 10 and moved into contacting engagement with at least two adjacent walls such as walls 27, 28, and/or 26. Then, two chock brackets 37 can be installed by mounting means, such as indicated above, so as to retain base portions of the TV adjacent to (but typically spaced inwardly from) the remaining wall, such as wall 24. Other arrangements can be used.

Subsequently, for use with a second TV having a different sized base, the chock brackets 37 can be separated from the surface of panel 11. For example, if a releasable adhesive mounting means has been used, each chock bracket 37 can be pried vertically upwards with a screw driver or the like to separate the chock bracket 37 from the surface of panel 11. Screws holding a chock bracket 37 can be removed and reset at another chock bracket location in panel 11. After positioning of the second TV, the chocks can be repositioned about the corners of that TV and again mounted to the surface of the panel 11.

Figure 5:
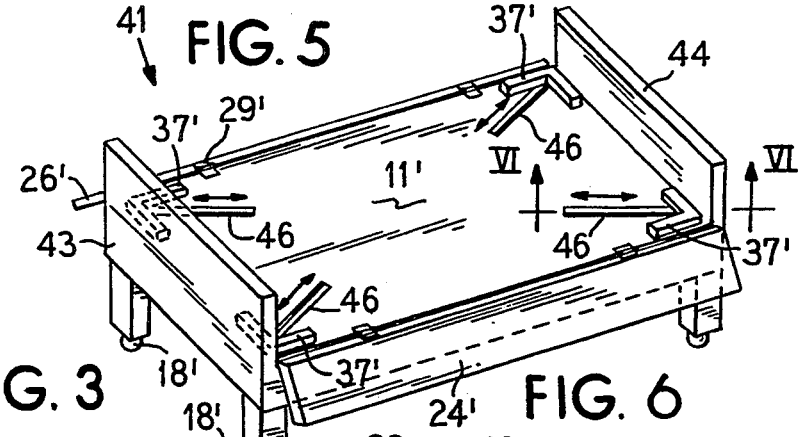
FIG. 5 is a perspective view of an alternative embodiment of my TV stand.
Figure 3:
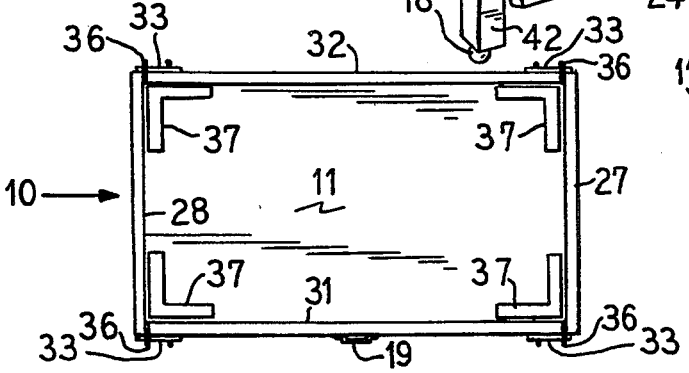
FIG. 3 is a top plan view of FIG. 1.
Figure 6:
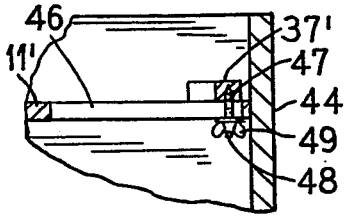
FIG. 6 is a fragmentary vertical cross-sectional view of the upper right corner region of FIG. 5 showing details of the adjustable chock bracket assembly.

Referring to FIGS. 5 and 6, there is seen another embodiment 41 of a TV stand of this invention. Similar parts are identically numbered, but with the addition of prime marks for identification. Here the panel 11' is supported by four vertically oriented legs 42, each of which preferably rests on a caster 18'. End walls 43 and 44 are mounted to the end edges of panel 11 and to adjacent portions of end pair of legs 42; and side walls 24' and 26' are mounted by hinge pairs 29' at each opposed side edge of panel 11'.

The side walls 24' and 26' are associated by bolt means (not shown) with end walls 43 and 44 in the manner described above for embodiment 10.

The panel 11' is provided with a diagonally inwardly extending slot 46 at each of its corners. A chock bracket 37' is positioned with its corner over a different one of each slot 46. A bolt 47 is threadably engaged with each bracket corner and its head 48 projects downwardly through slot 46 (see FIG. 6). Each head 48 is threadably engaged with a wing nut 49. Thus, when the wing nut 49 is tightened, the position of the associated chock bracket 37' is fixed relative to panel 11'. Thus, a TV can be positioned on panel 11' as desired and then its base can be restrained from sliding movements by these chock brackets 37' and the associated components.

If desired, a TV stand of this invention can be provided with a power supply cable and that cable can be associated with a female-type connector plug that is mounted to the stand for connection with the cord associated with the TV. Thus, the TV is associated with the stand only, and the stand can be moved without danger of pulling the power cord attached to the TV.

Other and further embodiments and arrangements for the stand structure of this invention can be employed and will be apparent to those skilled in the art from the foregoing description without departing from the spirit and scope of this invention.

What is claimed is:

1. A stand for supporting a screen-equipped television receiver without interference of screen viewability comprising:

a) a rectangular, horizontal, generally unitary panel means having a top surface, opposed ends, opposed sides and four corners, and including panel support means mounted on caster means for supporting said panel means in spaced, translatable relationship to an underlying floor surface;

(b) a pair of upstanding opposed end walls, each one of said end walls extending adjacent to and in contacting relationship with a different respective one of said opposed ends and being fixedly associated therewith, and each one of said end walls having a pair of lateral opposite end portions;

(c) a pair of opposed side walls, each one of said side walls extending adjacent to a different respective one of said opposed sides, and each one of said side walls having a pair of lateral opposite end portions;

(d) the relationship between said pair of end wall lateral opposite end portions and said pair of side wall lateral opposite end portions being such that an individual one of said end wall lateral opposite end portions adjoins a respective different one of said side wall lateral opposite end portions over each one of said corners when each one of said side walls is in an upstanding position that is also in contacting relationship with said adjacent respective one of said opposed sides, thereby to define an adjoining pair of wall end portions at each said corner and also to define an enclosed area on said top surface;

(e) hinge means associating each one of said pair of side walls with said adjacent respective one of said opposed sides for side wall pivotable movements relative thereto so that each one of said pair of side walls is outwardly and downwardly pivotable by said hinge means between said upstanding position and a downturned position;

(f) latch means functionally associated with each one of said end portions for reversibly individually engaging together said adjoining pair of wall end portions at each said corner so that each one of said pair of side walls is retainable in its said upstanding position; and (g) said panel means has a plurality of chock bracket means associated with said top surface with each one said plurality of chock bracket means being located adjacent to a different one of said corners for abuttingly engaging lower adjacent side portions of a screen equipped television receiver which rests upon said enclosed area, whereby said television receiver is stabilized and limited in horizontal sliding mobility; whereby (i) when said side walls are in their downturned position said television receiver is liftable and depositable on said panel means within said enclosed area, and (ii) when said television receiver is deposited within said enclosed area and said opposed side walls are in said upstanding position and so engaged together with said end walls by said latch means, said television receiver is fully visible over the adjacent one of said side walls.

2. The stand of claim 1 wherein each of said chock brackets is L-shaped when viewed in top plan.

* * * * *